US008960542B2

(12) United States Patent
Jaroh et al.

(10) Patent No.: US 8,960,542 B2
(45) Date of Patent: Feb. 24, 2015

(54) AIMING DEVICE FOR A BOMB DISARMING DISRUPTOR

(75) Inventors: Adam Jaroh, Johnstown, PA (US); George Lubert, Johnstown, PA (US); Jeremy Sitar, Portage, PA (US); David Metz, Duncansville, PA (US)

(73) Assignee: API Defense, Inc., Windber, PA (US)

( * ) Notice: Subject to any disclaimer, the term of this patent is extended or adjusted under 35 U.S.C. 154(b) by 1237 days.

(21) Appl. No.: 12/792,174

(22) Filed: Jun. 2, 2010

(65) Prior Publication Data

US 2012/0180366 A1 Jul. 19, 2012

(51) Int. Cl.
*G06F 19/00* (2011.01)

(52) U.S. Cl.
USPC ..... 235/400; 235/404

(58) Field of Classification Search
USPC ..... 235/400, 404, 406, 407, 414
See application file for complete search history.

(56) References Cited

U.S. PATENT DOCUMENTS

| | | | | |
|---|---|---|---|---|
| 8,104,186 | B2 | 1/2012 | Raschella et al. | |
| 2005/0081706 | A1* | 4/2005 | Alford | 89/1.13 |
| 2005/0268541 | A1* | 12/2005 | Young et al. | 44/535 |
| 2008/0060248 | A1* | 3/2008 | Pine et al. | 42/114 |
| 2012/0117848 | A1* | 5/2012 | Cox et al. | 42/130 |
| 2012/0118955 | A1* | 5/2012 | Cox et al. | 235/404 |

* cited by examiner

*Primary Examiner* — Karl D Frech
(74) *Attorney, Agent, or Firm* — RatnerPrestia

(57) ABSTRACT

A system for indicating a point of impact of a projectile fired from a barrel of a gun including a dynamic aiming device mounted to the barrel having a camera and a range finder configured to be pointed at a target. The system also includes a display device coupled to the camera for displaying an image of the target, and processing circuitry for superimposing a crosshair image on the displayed image of the target. The processing circuitry is configured to determine a distance from the dynamic aiming device to the target using the range finder and to adjust a position of the crosshair image. The position of the crosshair image is adjusted relative to the distance for indicating the point of impact of the projectile fired from the barrel.

16 Claims, 10 Drawing Sheets

Crosshair at distance X1

Crosshair at distance X1+X2

AIMING DEVICE FOR A BOMB DISARMING DISRUPTOR

The present invention relates to finding a point of impact of a projectile, in particular, a projectile fired from a bomb disarming disrupter (BDD).

BACKGROUND

In general, a BDD is a tool that bomb technicians utilize to detonate or disarm a bomb from a safe distance. The BDD includes a robot mounted gun which shoots a solid projectile or water shot at a package (e.g. the bomb). Determining the point of impact for the projectile is beneficial for safely disarming a bomb.

In some conventional systems, a camera is mounted to the barrel of the BDD. The camera captures a picture of a target (e.g. bomb), and then superimposes crosshairs onto the captured image which show the point of impact of a projectile fired from the BDD. These crosshairs, however, must be first calibrated at specific standoff distances (i.e. distances from the BDD to an intended target). Calibration is typically performed by inserting a boresight laser into the barrel of the BDD at a specific standoff distance. The crosshairs are then calibrated to intersect at the dot of the boresight laser illuminating the target. Once the crosshairs are calibrated, the boresight laser must be removed.

During a disarming mission, the BDD has to be positioned at one of the predetermined standoff distances utilized during calibration. Thus, conventional systems must calibrate the crosshairs for a finite number of standoff distances that may be utilized during disarming missions (the conventional system cannot automatically adjust for any given standoff distance). Conventional systems also place a burden on the technician to accurately estimate the standoff distance during the disarming mission (the conventional system cannot automatically determine the standoff distance).

SUMMARY

To meet this and other needs, and in view of its purposes, the present invention is embodied in a system for indicating a point of impact of a projectile fired from a barrel of a gun. The system includes a dynamic aiming device mounted to the barrel having a camera and a range finder configured to be pointed at a target. The system also includes a display device coupled to the camera for displaying an image of the target, and processing circuitry for superimposing a crosshair image on the displayed image of the target. The processing circuitry is configured to determine a distance from the dynamic aiming device to the target using the range finder and to adjust a position of the crosshair image. The position of the crosshair image is adjusted relative to the distance for indicating the point of impact of the projectile fired from the barrel.

It is understood that the foregoing general description and the following detailed description are exemplary, but are not restrictive, of the invention.

DETAILED DESCRIPTION

As described below, the example embodiments provide an aiming system for determining a point of impact of a projectile (e.g. solid projectile or water shot) fired from the barrel of a BDD. While the examples concern a BDD, it is contemplated that other types of guns may be used with the example aiming systems. The BDD may be maneuverable robot including a gun and an aiming system. In one embodiment, a laser aiming system (LAS) is mounted to a barrel of the BDD. The LAS may include two line lasers which project an intersection point corresponding to a point of impact (where the projectile will hit) on a target. In another embodiment, a dynamic aiming system (DAS) is mounted to the barrel of the BDD. The DAS may include a camera and a range finder. The range finder determines the standoff distance between the BDD and the target. A crosshairs image is then superimposed on a target image captured by the camera. The crosshairs are automatically adjusted based on the determined standoff distance.

As previously described, finding the true point of impact of a projectile fired from the BDD may be beneficial. In conventional systems, a boresight laser is inserted into the barrel of the BDD to indicate the point of impact for the projectile. The boresight laser, however, must then be removed in order to fire the projectile. Thus, it may be beneficial to implement a laser aiming system that indicates the true point of impact for the projectile, and does not need to be removed in order to fire the projectile.

Figure 1:
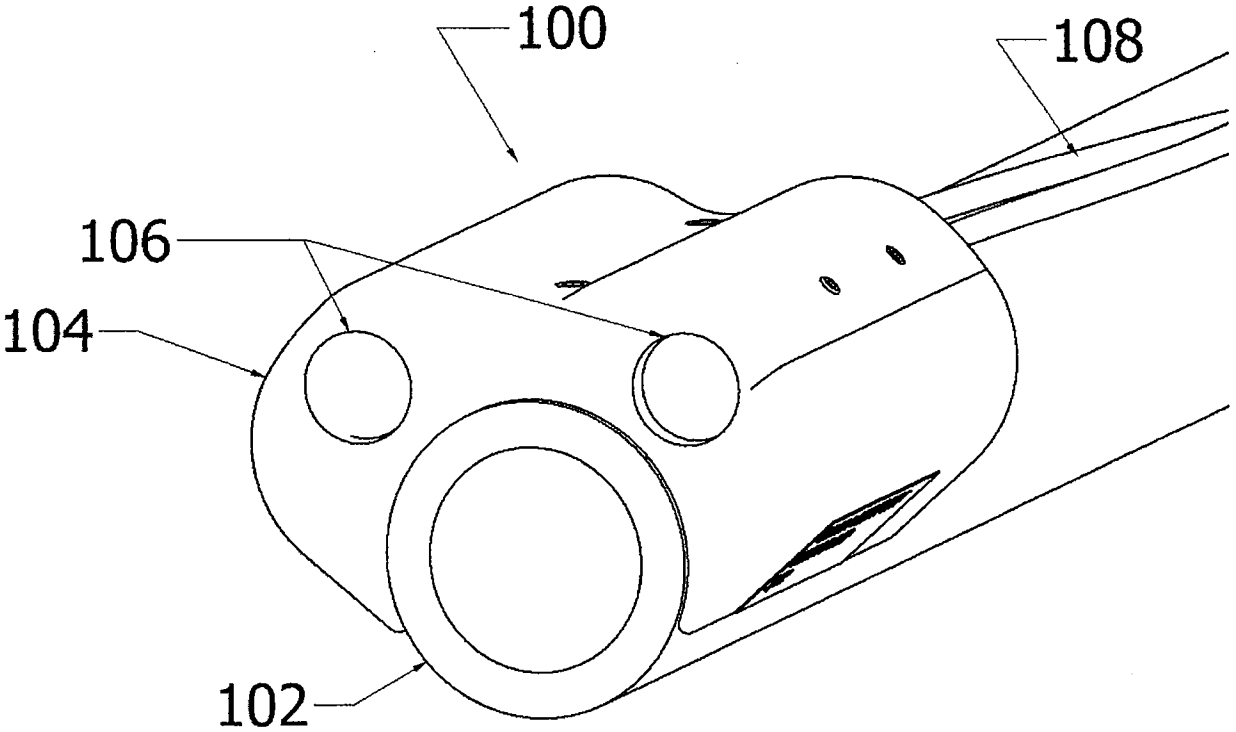
FIG. 1 is a perspective view of a laser aiming system (LAS) mounted to the barrel of a bomb disarming disruptor, according to an embodiment of the present invention.

Shown in FIG. 1, is a view of an example LAS including lasers 106 (e.g. Stocker Yales Lasiris Laser, Part Number: MINI-701L-635-10-15) which are positioned in housing 104 and mounted to barrel 102. Lasers 106 may be coupled to a power supply and a processor (not shown) through wires 108. In general, the example LAS includes at least two line lasers 106 (e.g. industrial grade lasers) which are enclosed in protective housing (e.g. rubber, plastic, metal) 104 and mounted to the barrel of the BDD by hardware (e.g. set screws, clamp). Epoxy (not shown) may also be included between housing 104 and barrel 102 to protect lasers 106 from vibrations and heat generated from firing the projectile. Housing 104 may also protect the lasers from damage (e.g. being hit by shrapnel) during a disarming mission.

In general, each line laser projects a laser line onto a target. In one example, the line lasers may have a wavelength of 635 nm, a power output of 10 mW and an optical fan angle of 15 degrees. The attitude of each of the lasers may be adjusted by a set screw (not shown) accessible through housing 104 so that the lines intersect each other at the target. The intersection point of the laser lines indicates the point of impact for a projectile fired from barrel 102 (regardless of the distance between the BDD and the target).

A boresight laser may be initially used to calibrate the line lasers. For example, a boresight laser may be inserted into the barrel of the BDD. The attitude of the line lasers may then be adjusted so that the intersection point coincides with the dot of the boresight laser. After calibration is complete, the boresight laser may be removed, and the line lasers may be used to aim the BDD.

Figure 2A:
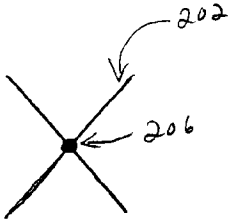
FIG. 2*a* is a plan view of an intersection for two lasers projected by the LAS of FIG. 1.
Figure 2B:
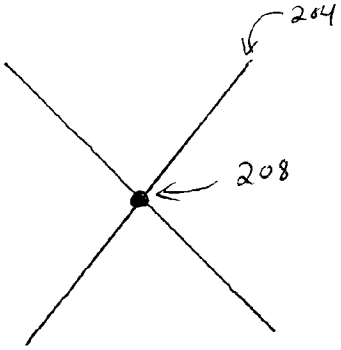
FIG. 2*b* is another plan view of an intersection for two lasers projected by the LAS of FIG. 1.

Shown in FIG. 2 is an example view of two line lasers projecting laser lines onto a target from two different distances (X1 and X1+X2). At a distance X1, the laser crosshairs are size 202, and their intersection 206 indicates the point of impact for the projectile. When the BDD is further away at distance X1+X2, the laser crosshairs are size 204 (larger), while their intersection 208 still indicates the point of impact for the projectile.

Thus, as the BDD is located at a distance further from the target, the laser crosshairs appear larger to the technician. The intersection point of the lines, however, is still maintained at the same point of impact. In general, the technician may use the intersection of the lines as an indicator for the true point of impact irrespective of the distance between the BDD and target.

In another embodiment, it may be beneficial to provide an image (e.g. real time video) of the target with a superimposed crosshair image indicating the point of impact for the projectile. It may also be beneficial to automatically adjust the superimposed crosshair image based on a detected distance between the BDD and the target.

Figure 3:
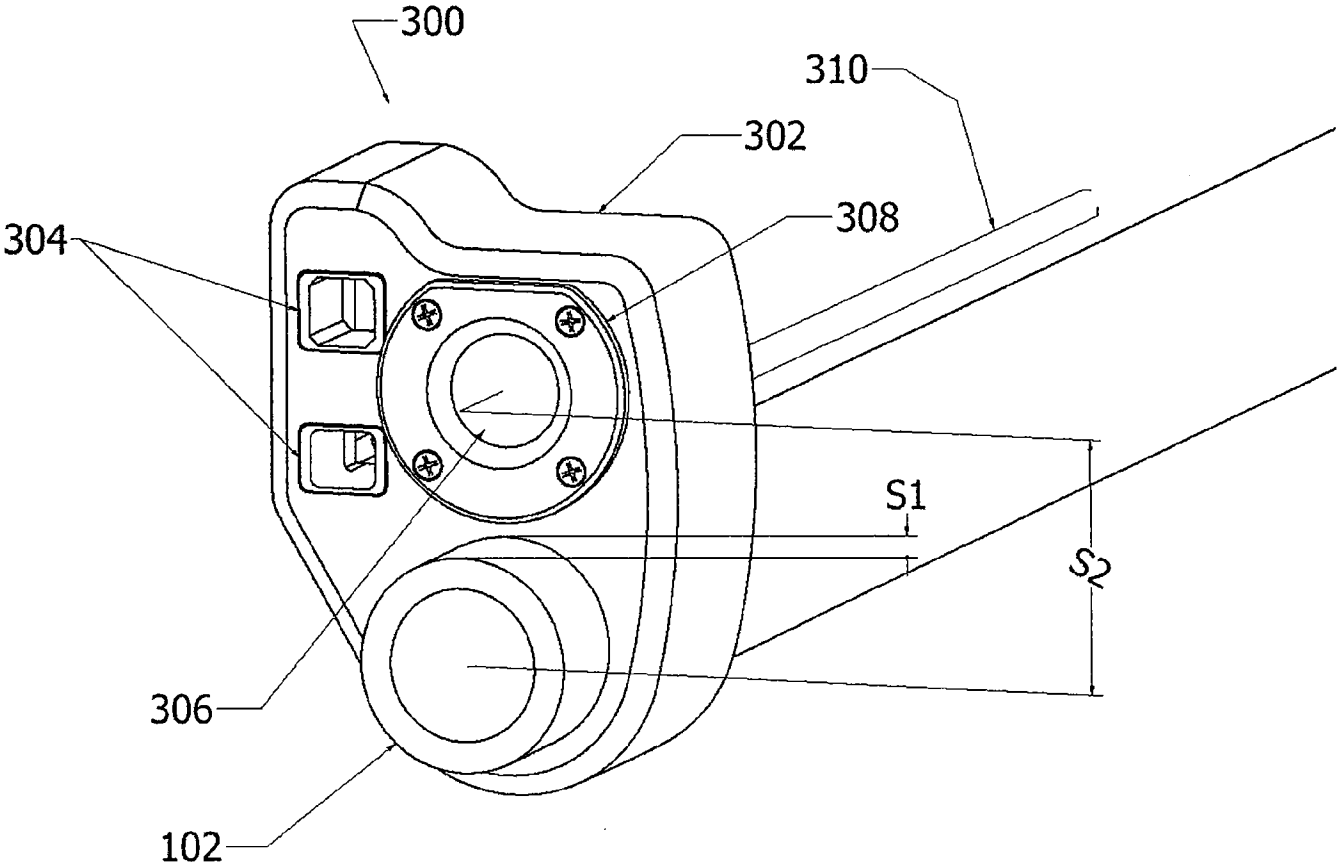
FIG. 3 is a perspective view of a dynamic aiming system (DAS) mounted to the barrel of a bomb disarming disruptor, according to an embodiment of the present invention.

Shown in FIG. 3 is an example DAS including camera 306 (e.g. Sharp, Part Number STC-N64L) protected by lens 308 (e.g. Sharp, Part Number LEN-N64L-3.0), and a range finder 304 (e.g. Sharp, Part Number GP2Y0A02YK0F) enclosed in housing 302 and mounted to barrel 102 of the BDD. In general, the dynamic system utilizes a onboard camera and range finding device to determine the point of impact for a projectile fired from the barrel. The example range finding device provides an analog voltage signal from which the distance to the target may be determined.

In one embodiment, camera 306 captures a target image (e.g. live video) of an intended target. The video is then displayed to a technician by a display device such as a computer monitor (not shown). Range finder 304 (e.g. infrared, laser, ultrasonic, stereoscopic or a combination system) then determines the distance to the intended target within a certain accuracy (e.g. 25.4 mm). The determined distance is utilized by a processor (not shown) to automatically adjust the position of the crosshair image which is superimposed on the target image. The superimposed crosshair image is automatically adjusted (by the processor) based on the determined distance to indicate the point of impact of the projectile. This allows the BDD to take an accurate shot at the target from any distance within the operating range of the range finder 304 (the distances do not have to be predetermined or estimated as in the conventional systems).

In general, the distance from the camera to the barrel is known. This allows the system to accurately superimpose the crosshair image on the target image. For example, as shown in FIG. 3, distance S1 (horizontal offset in the X axis) from the surface of the camera lens to the opening of the barrel, and distance S2 (vertical offset in the Z axis) from the center point of the camera lens to the center point of the opening of the barrel are both known by the system. S1 and S2 along with the determined distance to the target may then be utilized to accurately position the crosshair image.

For example, the system may subtract S1 from the distance determined by the rangefinder to compensate for horizontal (X axis) offset between the camera and the barrel. Similarly, the system may lower the crosshair image (in the vertical direction) by S2 to compensate for the vertical (Z axis) offset between the camera and barrel.

Figure 4:
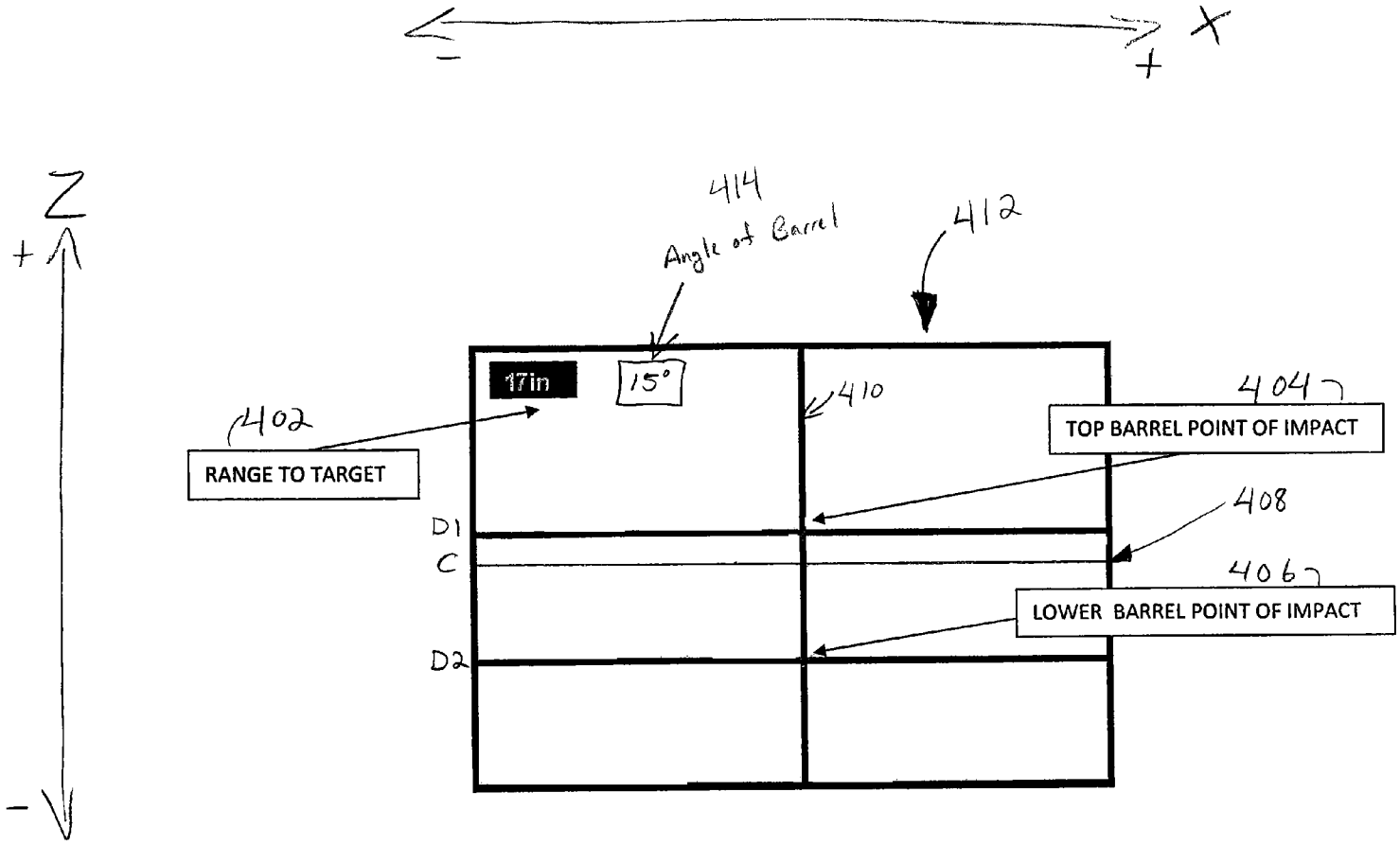
FIG. 4 is a plan view of crosshairs for a double barrel bomb disarming disruptor in FIG. 6, according to an embodiment of the present invention.
Figure 6:
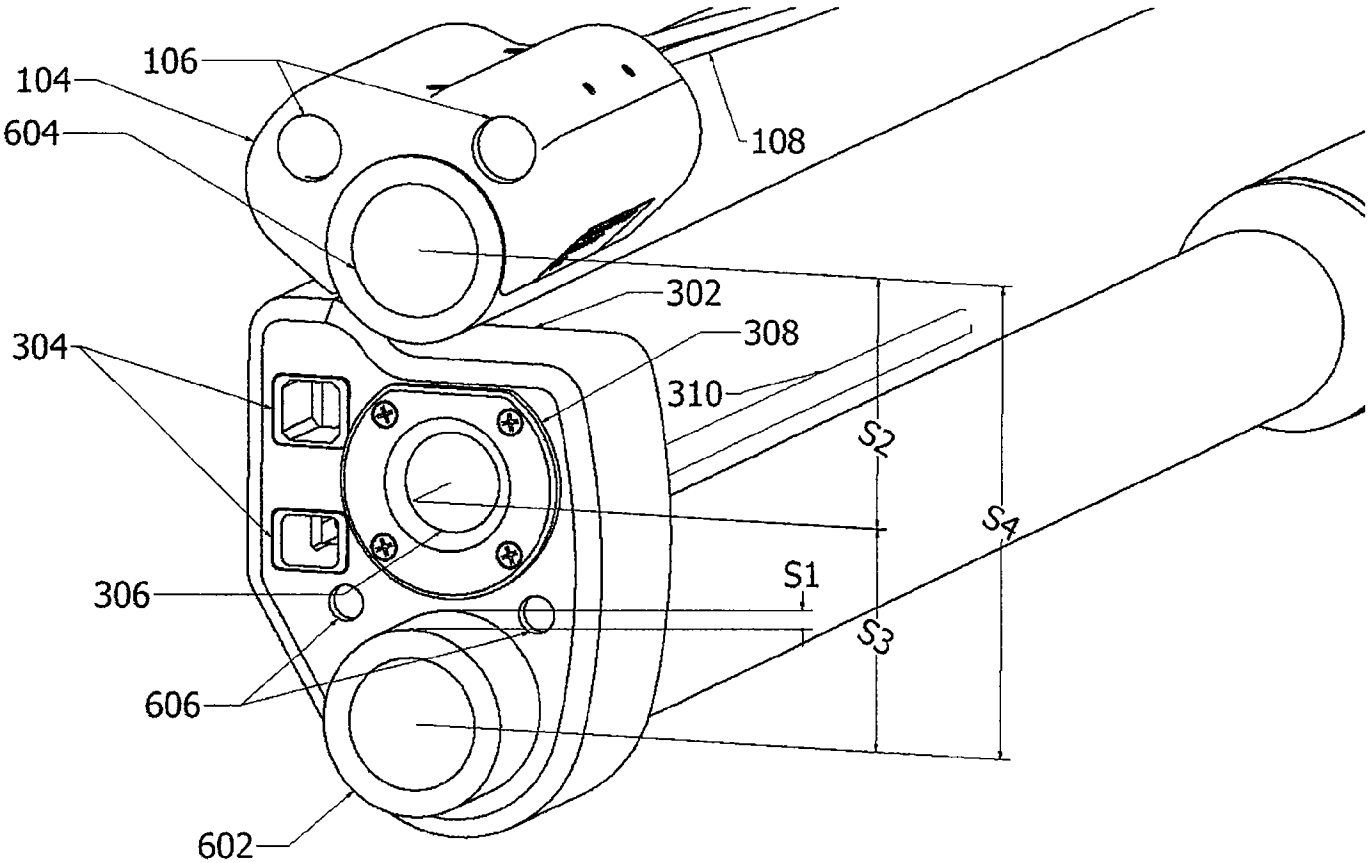
FIG. 6 is a perspective view of a combination aiming system including the LAS in FIG. 1 and the DAS in FIG. 3 mounted to a double barrel bomb disarming disruptor, according to an embodiment of the present invention.

In one embodiment, the DAS may be mounted on a double barrel (top and bottom barrel) BDD (see FIG. 6). In this embodiment, two crosshairs are displayed to the technician (a top crosshair for the top barrel and a bottom crosshair for the bottom barrel). An example of a double barrel crosshair image is shown in FIG. 4 which includes a superimposed top barrel crosshair image 404, bottom barrel crosshair image 406, vertical centerline 410 of the image and horizontal centerline 408 of the image.

During a disarming mission, the position of crosshairs 404 and 406 are automatically adjusted with respect to the determined distance to the target, known barrel to barrel separation (S4 in FIG. 6) and known camera to barrel separation (S1, S2 and S3 in FIG. 6).

In a double barrel BDD (shown in FIG. 6), for example, the center of the top and bottom barrels may have a barrel to barrel separation S4 of 76.2 mm, camera to top barrel separation S2 of 25.4 mm, camera to bottom barrel separation S3 of 50.8 mm and camera surface to barrel opening separation S1 of 19.05 mm. In one example, if S4 is 76.2 mm, then the system places the crosshairs for the top and bottom barrel at a vertical (Z axis) distance of 76.2 mm apart. A crosshair image is thereby provided showing the point of impacts for the top and bottom barrels to be 76.2 mm apart at the target in the scene.

In order to properly place the crosshair image, the size of the scene in the target image is determined. In one example, if the BDD is 381 mm from the target, image 412 may be imaging a 256 mm (X axis) by 256 mm (Z axis) scene (depending on parameters of the camera such as zoom factor and field of view). The crosshairs may then be adjusted on a pixel by pixel basis so that the technician perceives the point of impact for the top and bottom projectiles to coincide with the separation S4 between the top and bottom barrels.

For example, if S4 is 75 mm, S2 is 25 mm, S3 is 50 mm, S1 is 19 mm, and the distance from the camera to the target is 800 mm, then the following steps may be performed. First, the distance from the end of the barrel to the target is determined to be 781 mm by subtracting 19 mm from 800 mm (this distance may be displayed to the technician as shown in FIG. 4). Second, the size of the scene in the image is determined to be 256 mm by 256 mm based on the camera field of view and the distance from the camera to the target (the larger the field of view and the further the distance results in a larger scene).

Third, the corresponding size of each individual pixel is determined based on the overall size of the scene and the dimensions of the imager. For example, if the camera includes an imager having 256 pixels (X axis) by 256 pixels (Z axis), then each pixel would have a corresponding scene size of 1 mm (each pixel represents 1 mm within the scene).

Fourth, the pixel deviation (D1 and D2) from the horizontal centerline 408 to the crosshairs is determined based on S2 and S3. For example, the top crosshair would be placed in the image at deviation D1 crossing the $25^{th}$ pixel above the centerline 408, and the bottom crosshair would be placed in the image at deviation D2 crossing the $75^{th}$ pixel below the centerline 408.

If the BDD moves farther away from the target, the crosshairs (if static) would incorrectly indicate that the projectiles would impact at points further apart than the barrel to barrel separation. Thus, in the present invention, if the BDD moves farther from the target (e.g. 1600 mm from the target), image 412 may be imaging a larger 512 mm by 512 mm scene (each pixel of the 256 by 256 pixel imager has a corresponding scene size of 2 mm). In this example, the crosshairs would have to be automatically adjusted closer to each other (in the Z axis) so that the technician still perceives the point of impact for the top and bottom projectiles to coincide with the separation S4 between the top and bottom barrels. For example, since each pixel represents 2 mm in the scene, the top crosshair would be placed in the image at a deviation crossing the $12^{th}$ pixel above the centerline 408, and the bottom crosshair would be placed in the image at a deviation crossing the $37^{th}$ pixel below the centerline.

In some applications, the angle of the barrel may also be important to the technician. For example, if the BDD is utilized in a mission for disarming a pipe bomb, the angle of the barrel may need to be within the range of 14-17 degrees to knock a cap off the pipe bomb. Thus, an accelerometer (not shown) may also be included in the DAS for determining the angle of the barrel (e.g. in the Z axis) with respect to the earth. By displaying the angle of the barrel 414 in FIG. 4, the technician is able to select a mission specific angle.

Figure 5:
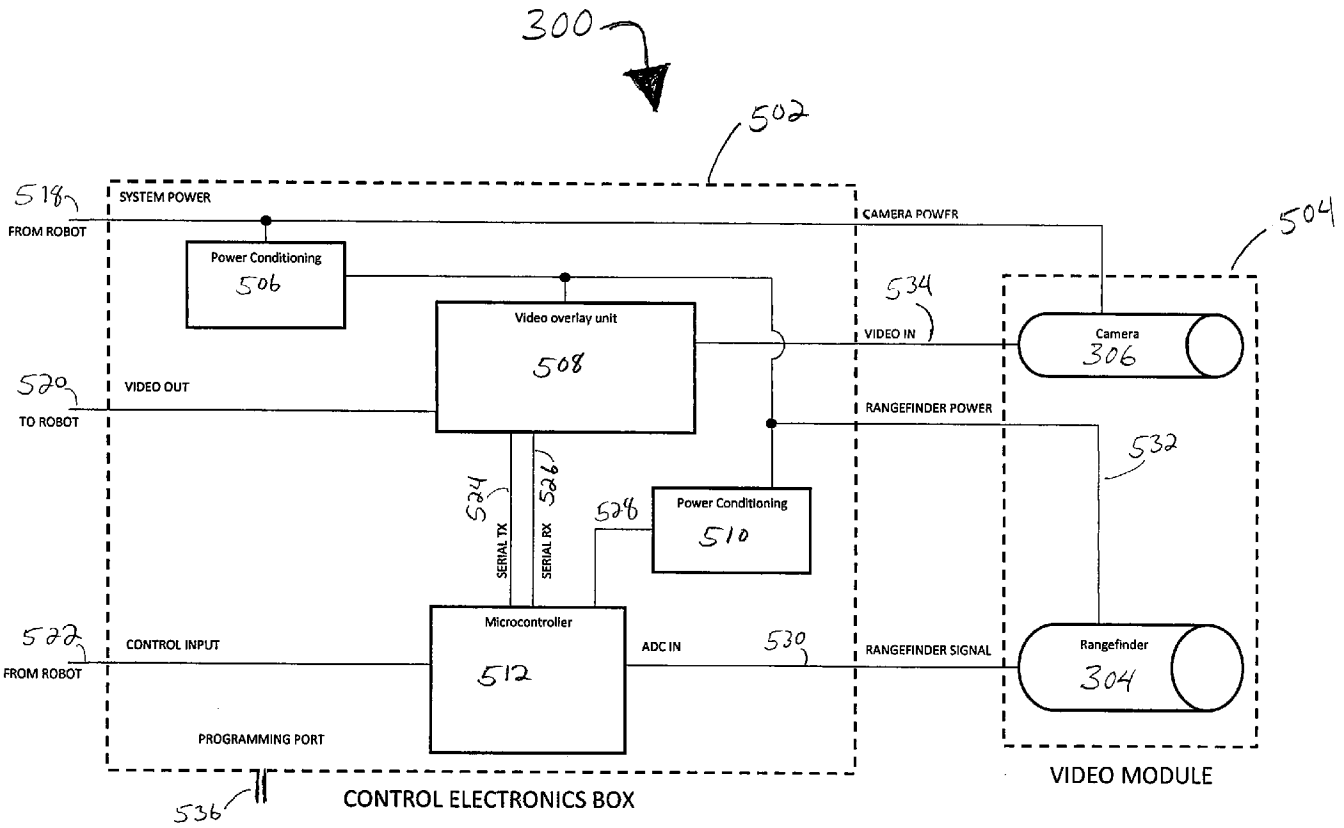
FIG. 5 is a block diagram of the DAS in FIG. 3, according to an embodiment of the present invention.

Various components are included in the DAS of FIG. 3. Shown in FIG. 5 is a block diagram of these components. The hardware of the DAS may include a control box 502 and a video module 504. Control box 502 includes power conditioning modules 506 and 510, video overlay unit 508 and microcontroller 512. Video module 504 includes camera 306 and range finder 304.

Camera 306, range finder 304, video overlay unit 508 and microcontroller 512 receive power from the BDD robot through line 518. Conditioning circuits 506 and 510 (e.g. voltage regulator) may condition the power from the robot to protect the electronic circuits in the control box and video module. During operation (e.g. during a bomb disarming mission), when the BDD is aimed at a target, camera 306 captures an image of the target and sends the image to video overlay unit 508 through line 534. The camera may also include formatting circuitry to produce a national television system committee (NTSC) image. In one embodiment, range finder 304 transmits an infrared signal from the BDD towards the target. The reflected infrared signal is then detected and converted into an analog voltage signal by the rangefinder. The voltage signal is then sent to microcontroller 512 through line 530.

Microcontroller 512 converts the received voltage signal to a value indicating the distance (e.g. in mm) between the BDD and the target. Based on the computed distance, known barrel to barrel separation (when double barrel), known camera to barrel separation and other camera parameters such as resolution, processing circuitry (e.g. microcontroller 512) computes the point of impact for the BDD projectiles. Microcontroller 512 then instructs video overlay unit 508 (i.e. through lines 524 and 526) to overlay a crosshair image on the target image captured by the camera. The video overlay unit 508 then outputs the target image with the superimposed crosshairs to the robot through video line 520 where it is displayed in real time to the technician.

It is noted that control box 502 includes a control input 522 from the robot. Control input 522 allows circuitry on the robot to control microcontroller 512. A programming port may also be included in control box 502 allowing the technician to program microcontroller 512. Furthermore, lines 518, 520 and 522 may be extended as line 310 along barrel 102 from DAS housing 302 to the robot.

As shown in FIG. 1, the LAS may be mounted to the barrel of a BDD for determining the point of impact of a projectile. As shown in FIG. 3, a DAS having a camera and a range finder may be mounted to the barrel of a BDD for determining the point of impact of the projectile. In certain situations it may be beneficial to configure both the LAS and DAS on the BDD as a combination aiming system.

Shown in FIG. 6, is an embodiment of a combination aiming system including the LAS of FIG. 1 and the DAS of FIG. 3 (having optional lasers 606). The combination aiming system is implemented on a double barrel BDD. Specifically, the DAS is mounted on bottom barrel 602, while the LAS is mounted on the top barrel 604. It should be noted, however, that the combination system may also be reversed where the LAS is mounted on the top barrel and the DAS is mounted on the bottom barrel. The combination system may also be implemented on a single barrel BDD, where both the DAS and LAS may be housed in a single housing (e.g. the DAS 302 also includes camera 306, rangefinder 304 and two optional line lasers 606 in the same housing).

In one embodiment, the DAS may be utilized as the primary aiming system while the LAS may be utilized as a backup aiming system. For example, if the DAS is able to determine the distance to the target, then the crosshairs are superimposed on the image for the technician. If the DAS cannot determine the distance to the target, however (e.g. due to reflective properties of the target), then the LAS may be utilized by the technician instead.

In another embodiment, lasers 106 of the LAS and optional lasers 606 of the DAS (top and bottom lasers) may be used to confirm the accuracy of crosshairs in the DAS. For example, the technician may confirm that the crosshairs displayed in the image by the DAS correspond to the laser crosshairs.

Figure 7:
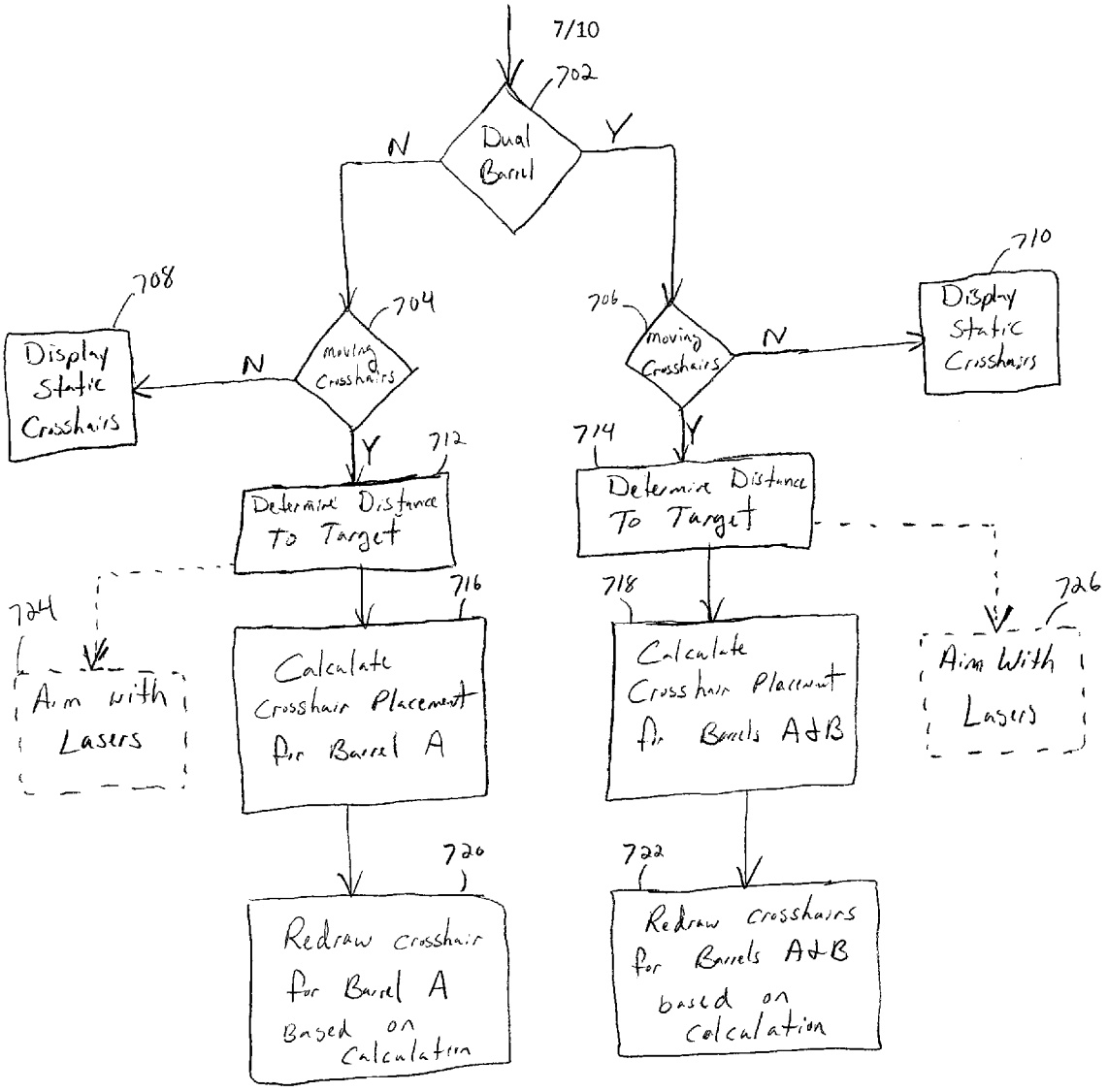
FIG. 7 is a flowchart showing the operational steps for the DAS in FIGS. 3 and 6, according to an embodiment of the present invention.

Operation of an embodiment of the BDD is now described with respect to the flowchart of FIG. 7. A decision is made (step 702) as to whether the BDD is a single barrel (e.g. FIG. 3) or dual barrel (e.g. FIG. 6) system. A decision is then made (steps 704/706) as to whether the technician has selected moving or static crosshairs. If the technician selects static crosshairs, then static crosshairs are superimposed on the image (steps 708/710). If the technician selects moving crosshairs, however, the rangefinder of the DAS determines the distance to the target (steps 712/714). If the rangefinder cannot determine the distance to the target (e.g. due to the reflective properties of the target surface or reflections from an intermediate surface), then the BDD (if it is a combination DAS/LAS system) may optionally use the lasers 106 and 606 (steps 724/726). Once the distance is accurately determined, the BDD calculates the placement of the crosshairs (steps 716/718) and superimposes the crosshairs on the image (steps 720/722).

Figure 8:
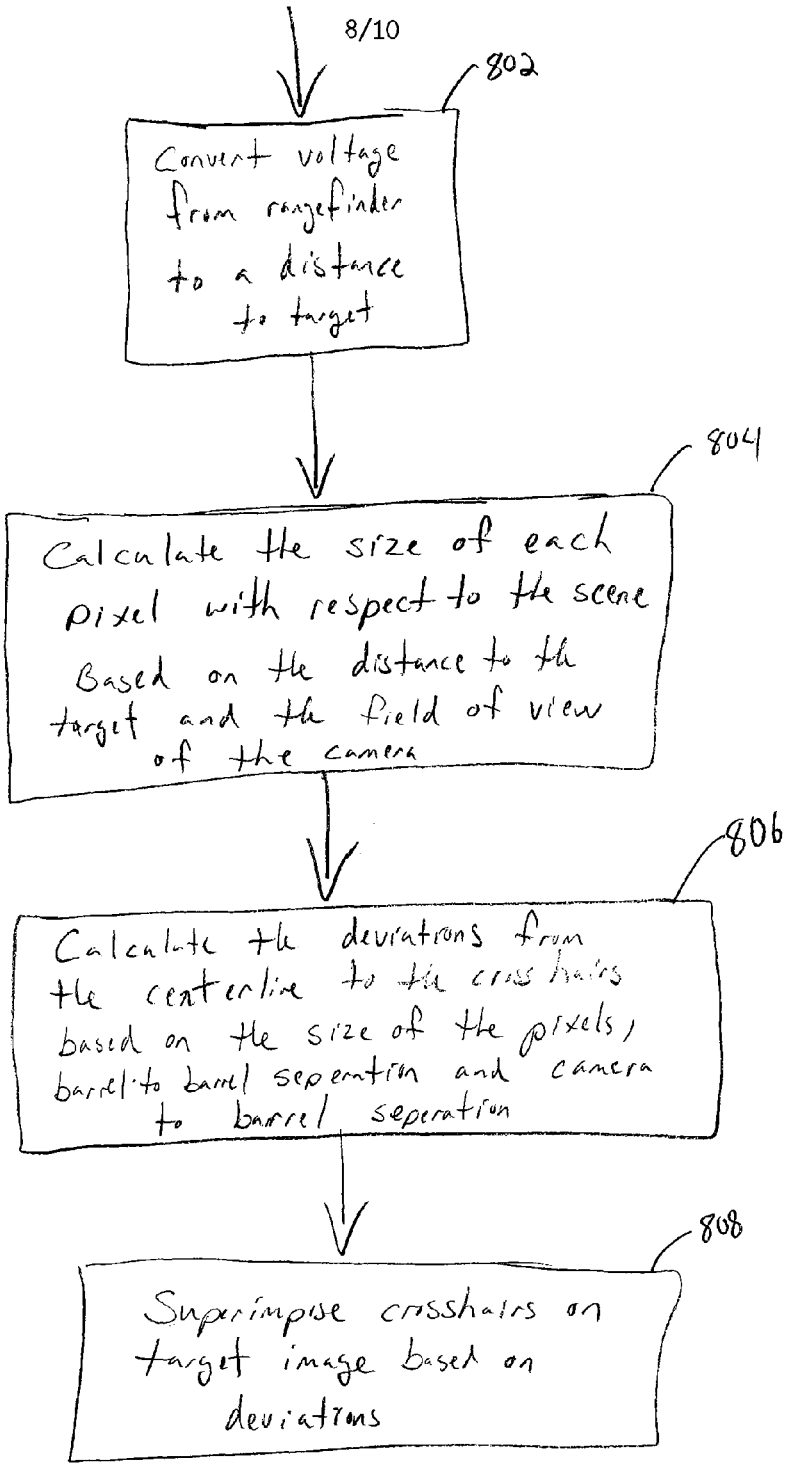
FIG. 8 is a flowchart showing further operational steps for the DAS in FIGS. 3 and 6, according to an embodiment of the present invention.

Further details on calculating the placement of the crosshair image are provided in the flowchart of FIG. 8. In step 802, the rangefinder voltage signal is converted into a distance value. In step 804, the size of the pixels with respect to the scene are determined based on the distance value between the BDD and the target and the field of view of the camera. In step 806, the deviations of the crosshairs from the horizontal centerline (line 408 in FIG. 4) are calculated based on the scene size of each pixel, known barrel-to-barrel separation (S4 if the system is a dual barrel system), and known camera-to-barrel separation (e.g. S1-S3). Once the deviations from the centerline are determined, the crosshair image is superimposed on the target image (step 808).

Figure 9:
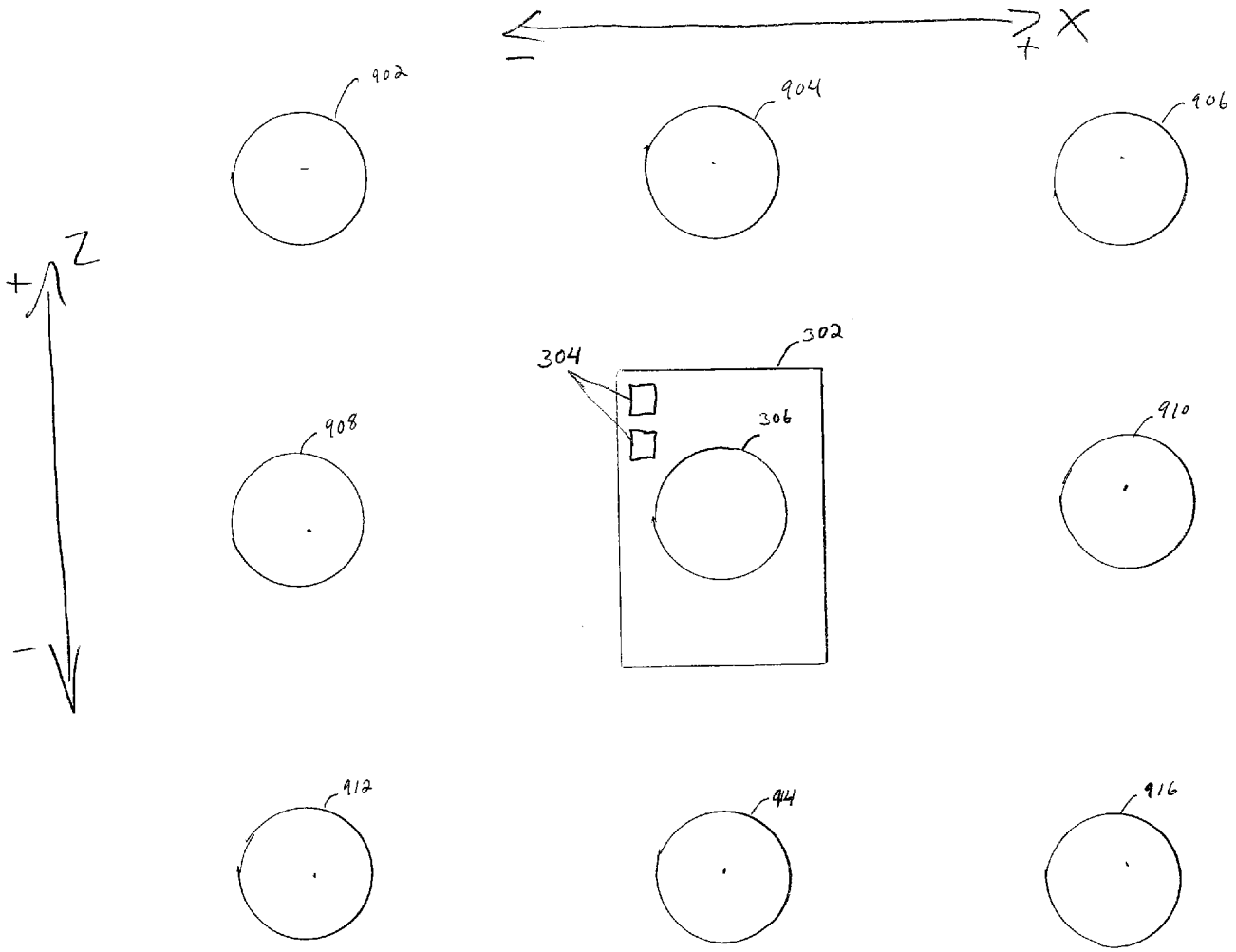
FIG. 9 is a view of a DAS mounted in the middle of a matrix of barrels on a bomb disarming disruptor, according to an embodiment of the present invention.

It is also contemplated that the barrels of the BDD may be side by side and/or that there may be more than two barrels (various configurations). For example, FIG. 9 shows an embodiment of a BDD having eight barrels (902-916) arranged in a matrix surrounding camera 306 of the DAS. Similar to the operation of the BDDs described above in FIGS. 7 and 8, the BDD in FIG. 9 can compute and adjust crosshairs for each of the eight barrels based on determined distance to the target, known camera to barrel separation and camera parameters (e.g. resolution and field of view).

Figure 10:
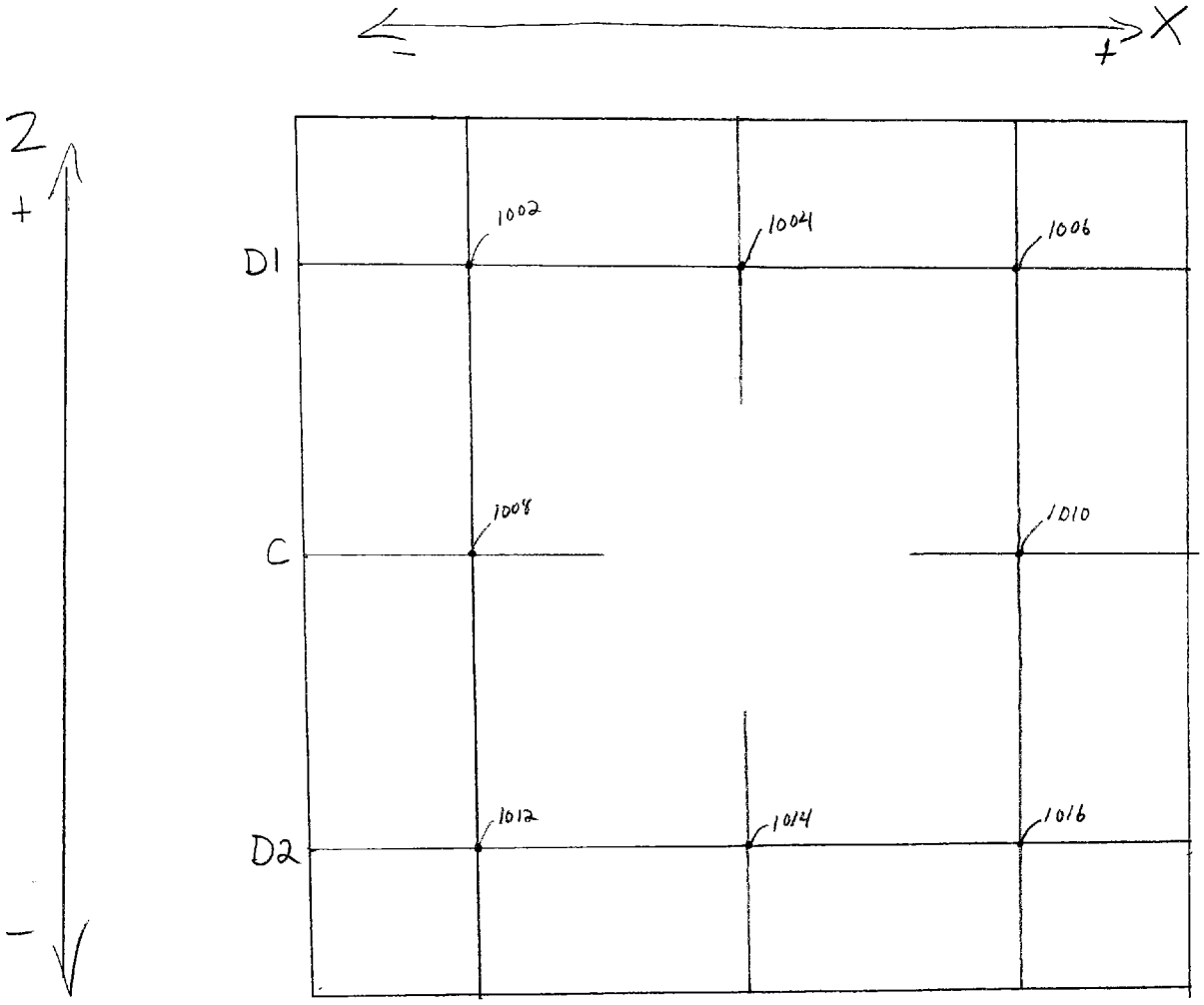
FIG. 10 is a view of crosshairs for the matrix of barrels on the bomb disarming disruptor of FIG. 9, according to an embodiment of the present invention.

Shown in FIG. 10 is a target image displayed to a technician. The target image includes eight crosshairs indicating the points of impact (1002-1016) for the eight respective barrels (902-916). Crosshairs 1002-1006 and 1012-1016 are placed at a determined deviations D1 and D2 respectively from centerline C. Crosshairs 1008 and 1010 are placed on the centerline because barrels 908 and 910 are lined up with the center of the camera (See FIG. 9). It should be noted that each of the barrels 901-916 may also have lasers mounted thereon (not shown) similar to 106 shown in FIG. 1 for providing LAS capabilities.

In general, the LAS, DAS and combination LAS/DAS provides the technician with visual indicators for determining the points of impact for projectiles fired from the BDD. These visual indicators are accurate within the operational range of the range finder regardless of the distance to the target.

It is also contemplated that the distance to the target may be determined in various other manners. In one embodiment, the system may include an infrared laser to determine the point of impact, and a video processing unit to determine the distance to the target (based on the location of the infrared laser within the image).

In another embodiment, the size of various standard objects (e.g. size of a human head) may be characterized and stored. By comparing a real time target image of a human head to the standard size human head stored in memory, a video processor may determine the distance to the target and automatically adjust the point of impact appropriately. In this embodiment, since the target may be far away, the system may also compensate for gravitational effects and air resistance using known projectile equations.

As described above, the size of the lasers crosshair of the LAS (See FIGS. 2*a* and 2*b*) increases proportional to the distance between the BDD and the target. Thus, in another embodiment, the size (determined by image processing) of the laser crosshair in the LAS may be used to determine distance to the target.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. An aiming system for indicating a point of impact of a projectile fired from a gun having a first barrel configured to file a first projectile and a second barrel configured to fire a second projectile, the aiming system comprising:

a dynamic aiming device mounted to at least one of the first and second barrels, the dynamic aiming device including a camera, having a front lens which has a center point and a range finder configured to be pointed at a target, wherein a lens surface of the front lens of the camera is positioned at a first camera to barrel distance from an end of the first and second barrels, and a center point of the lens is positioned at a second and a third camera to barrel distance from a center opening of the first and second barrels, respectively;

a display device coupled to the camera for displaying an image of the target; and processing circuitry for superimposing first and second crosshair images on the displayed image of the target corresponding to respective points of impact of the projectiles fired from the first and second barrels, wherein the processing circuitry is configured to determine a distance from the dynamic aiming device to the target using the range finder and to adjust respective positions of the first and second crosshair images, the position of the crosshair images being adjusted relative to the determined distance and to the first, second and third camera to barrel distances for indicating the point of impact of the respective projectiles fired from the first and second barrels.

2. The aiming system of claim 1, wherein:

the rangefinder is positioned in the dynamic aiming device to determine the distance from the front lens of the camera to the target.

3. The aiming system of claim 1, wherein:

the processing circuitry is configured to calculate an overall size of a scene in the image, and a corresponding size of the pixels in the scene based on the determined distance and a field of view of the camera, and the processing circuitry is configured to calculate a deviation of the crosshair image from a centerline in the target image based on the pixel size, and position the crosshair image at that deviation.

4. The aiming system of claim 1, wherein:

the processing circuitry includes:

a microcontroller configured to determine the position of the crosshair image, and a video overlay unit configured to overlay the crosshair image on the target image at the position determined by the microcontroller.

5. The aiming system of claim 1, including:

an accelerometer mounted in the dynamic aiming system for determining a vertical angle of the barrel with respect to the earth.

6. The aiming system of claim 1, wherein:

the first barrel is a top barrel configured to fire a top projectile and the second barrel is a bottom barrel configured to fire a bottom projectile;

the dynamic aiming device is mounted to the bottom barrel such that a lens surface of the camera is positioned at the first camera to barrel distance, being a distance from an end of the top and bottom barrel, and the second and third camera to barrel distances, being respective distances from center point of the lens from a center opening of the top and bottom barrel respectively; and a processor is configured to determine a size of the scene in the target image and a corresponding size of each pixel in the scene based on the determined distance to the target and the camera field of view, and the processor places the crosshair image at a pixel deviation from a centerline in the target image based on the size of the pixels in the scene.

7. The aiming system of claim 6, including:

a top laser aiming device mounted to the top barrel and a bottom laser aiming device mounted to the bottom barrel, wherein the top laser aiming device and bottom laser aiming device each include two line lasers positioned to intersect at respective points of impact of the top and bottom projectiles respectively.

8. The aiming system of claim 1, wherein:

the gun is a bomb disarming disruptor configured to fire the projectile at a bomb.

9. The aiming system of claim 1, wherein:

the projectile is a water charge produced by injecting water into the barrel of the gun.

10. The aiming system of claim 1, wherein the gun includes between two and eight barrels and the aiming system is configured to superimpose respective crosshair images on the displayed image of the target corresponding to respective points of impact of the projectiles fired by respective ones of the barrels.

11. An aiming system for indicating a point of impact of a projectile fired from a barrel of a gun comprising:

a laser aiming device mounted to the barrel, the laser aiming device including two line lasers configured to produce projected laser lines on a target, wherein the line lasers are positioned on the barrel such that an intersection point between the two laser lines indicates the point of impact of the projectile fired from the barrel.

12. The aiming system of claim 11, wherein:

the line lasers have an optical fan angle for projecting the laser lines, the length of the projected laser lines defined based on the optical fan angle and a distance between the line lasers and the target, and the line lasers are oriented with respect to each other so that the laser lines intersect at the point of impact regardless of the distance between the line lasers and the target.

13. The aiming system of claim 12, wherein:

the optical fan angle of the laser is 15 degrees and a power of the line lasers is 10 mW.

14. The aiming system of claim 11, including:

a gun having a top barrel configured to fire a top projectile and a bottom barrel configured to fire a bottom projectile, wherein a top laser aiming device is mounted to the top barrel and a bottom laser aiming device is mounted to the bottom barrel, the top and bottom laser aiming devices providing indications of respective points of impact for the top and bottom barrels respectively.

15. The aiming system of claim 11, including:

a housing for protecting the lasers from shrapnel produced by the target upon being hit by the projectile, wherein the housing also protects the lasers from vibrations from the barrel.

16. The aiming system of claim 11, wherein the lasers are positioned on the barrel such that the intersection point between the two laser lines indicates the same point of impact of the projectile on the target irrespective of a distance between the barrel of the gun and the target.

* * * * *